US008177456B2

(12) United States Patent
Haroldsen

(10) Patent No.: US 8,177,456 B2
(45) Date of Patent: May 15, 2012

(54) PAVEMENT MILLING ASSEMBLY

(75) Inventor: J. Tron Haroldsen, Herriman, UT (US)

(73) Assignee: Asphalt Zipper, Inc., Pleasant Grove, UT (US)

( * ) Notice: Subject to any disclaimer, the term of this patent is extended or adjusted under 35 U.S.C. 154(b) by 226 days.

(21) Appl. No.: 12/337,947

(22) Filed: Dec. 18, 2008

(65) Prior Publication Data

US 2009/0185859 A1 Jul. 23, 2009

Related U.S. Application Data

(60) Provisional application No. 61/015,937, filed on Dec. 21, 2007.

(51) Int. Cl.
*E01C 23/16* (2006.01)
*E21C 25/00* (2006.01)

(52) U.S. Cl. ..... 404/94; 299/39.2; 299/39.4

(58) Field of Classification Search ..... 404/94; 299/39.1, 39.2, 39.4, 39.8; 37/386
See application file for complete search history.

(56) References Cited

U.S. PATENT DOCUMENTS

| | | | | |
|---|---|---|---|---|
| 1,670,502 | A * | 5/1928 | Gray | 37/386 |
| 2,905,456 | A * | 9/1959 | Rafferty et al. | 299/39.8 |
| 3,703,316 | A | 11/1972 | Hatcher et al. | |
| 4,637,753 | A * | 1/1987 | Swisher, Jr. | 404/90 |
| 4,896,995 | A * | 1/1990 | Simmons | 404/90 |
| 5,232,305 | A * | 8/1993 | Bassett et al. | 404/101 |
| 5,354,147 | A * | 10/1994 | Swisher, Jr. | 299/39.6 |
| 5,695,255 | A * | 12/1997 | LeBlond | 299/39.1 |
| 5,893,677 | A * | 4/1999 | Haehn et al. | 404/90 |
| 6,565,281 | B2 * | 5/2003 | Bruns et al. | 404/90 |
| 6,623,083 | B1 | 9/2003 | Risi | |
| 6,718,660 | B2 * | 4/2004 | Rivard | 37/347 |
| 7,004,675 | B2 * | 2/2006 | Wayne | 404/91 |
| 7,144,087 | B2 * | 12/2006 | Haroldsen et al. | 299/39.1 |
| 2004/0148823 | A1 | 8/2004 | Schenk | |
| 2005/0123350 | A1 | 6/2005 | Ley et al. | |

* cited by examiner

*Primary Examiner* — Thomas Will
*Assistant Examiner* — Abigail A Risic
(74) *Attorney, Agent, or Firm* — Madson IP, P.C.

(57) ABSTRACT

A pavement milling sled upholds a rotating pavement milling drum during travel over pavement preselected for milling. Coplanar lower faces of laterally-separated left and right runners configured for sliding travel on the surface of the pavement define a sled floor. A milling frame mounted between the runners circumscribes a milling region, wherein rotation of the milling drum dislodges pavement located in the path the sled below the sled floor, pulverizes dislodged pavement, and deposits pulverized pavement to the rear of the sled. Left and right milling region sidewalls extend upwardly from the sled floor on opposite sides of the milling region. A guard plate is secured between the milling region sidewalls forward of the milling region at a distance above the sled floor. A discharge baffle extends between the milling region sidewalls at the back of the milling region in close proximity to the sled floor. The discharge baffle includes a rear wall separated from the floor extending upwardly between the milling region sidewalls at the back of the milling region, and a vertically-adjustable pulverized pavement exit gate depending from the rear wall. Milling region sidewalls project forward of the guard plate forming opposed sidewalls of an entry scoop having a mouth located at the front of the sled, a roofing plate bridging between the sidewalls of the entry scoop at a distance above the floor of the sled, and a downwardly depending pivotable admission flap mounted across the mouth of the entry scoop.

18 Claims, 6 Drawing Sheets

PAVEMENT MILLING ASSEMBLY

CROSS-REFERENCED RELATED APPLICATIONS

This patent application claims the benefit of U.S. Provisional Patent Application Ser. No. 61/015,937 that was filed on Dec. 21, 2007, for an invention titled, SYSTEMS AND METHODS FOR INCREASING MATERIAL REGRINDING AND CONTROLLING MILLING DEPTH.

BACKGROUND OF THE INVENTION

1. Field of the Invention

The present invention relates to systems and methods for milling installed pavement, such as asphalt, concrete, and tarmac. More specifically, the present invention relates to systems and methods that enhance the thorough milling of installed pavement.

2. The Relevant Technology

Pavement milling is currently employed to remove existing pavement for reconstruction, resurfacing, or reuse. Known pavement milling assemblies are attached to a drivable construction vehicle, such as a front end loader, forward of the wheels or tracks thereof. The construction vehicle then propels the attached pavement milling assembly over pavement preselected for milling.

Known asphalt milling assemblies have drawbacks, however.

For example, known pavement milling assemblies reliably retain the pavement material being milled, only when the depth of the cut of the pavement material to be milled is the maxim milling depth attainable using the pavement milling assembly being employed. Otherwise, known pavement milling assemblies permit dislodged paving material that is being pulverized into granules to escape from the milling assembly, becoming lost or unusable. Typically, the pavement material that escapes from a pavement milling assembly in this manner has not been milled sufficiently to be in granules of a desirably small size. To avoid being wasted, the escaped pavement material must be collected manually and reprocessed in supplemental equipment before becoming of a size acceptable for reuse. This is costly and inefficient, and frequently is simply not performed at all.

Then also, most known pavement milling assemblies are supported in part on a wheel that upholds the front end of the pavement milling assembly on the surface of the pavement to be milled in the direction of the forward travel of the pavement milling assembly itself. This support of the pavement milling assembly on a relatively small area of pavement that is about to be milled determines the depth at which milling occurs. Unfortunately, as a propelling vehicle drives the pavement milling assembly from behind, over uneven surfaces, partially-milled material, or other debris, contact between the support wheel and the pavement is frequently lost entirely. Thus, it is difficult to precisely control the depth at which pavement milling occurs.

In addition propelling vehicles experience numerous mechanical problems, such as hydraulic leaks, that cause the connection between the propelling vehicle and the pavement milling assembly to drift, to adjust, or to be temporarily lost. If the depth of pavement milling is to be maintained constant, the occurrence of such exigencies require repeated corrective adjustments and accommodations to the propelling vehicle and to the attachment between the propelling vehicle and the pavement milling assembly.

BRIEF SUMMARY OF THE INVENTION

The present invention has been developed in response to the present state of the art, and in particular, in response to the problems and needs in the art that have not yet been fully solved by known pavement milling assemblies.

According to one aspect of the present invention, a pavement milling sled is provided of the type that upholds a rotating pavement milling drum as the sled travels over pavement preselected for milling. The milling sled includes laterally-separated left and right runners, each of which has a lead end oriented toward the front of the sled and a lower face configured for sliding travel on the surface of the pavement. The lower faces of the runners are substantially coplanar and thereby define a floor of the sled.

A milling frame is mounted between the runners. The milling frame circumscribes a milling region in which rotation of the milling drum dislodges pavement located in the path of forward travel of the sled below the floor of the sled, pulverizes dislodged pavement, and deposits pulverized pavement to the rear of the sled. The milling frame itself includes left and right milling region sidewalls that extend upwardly from the floor of the sled on opposite sides of the milling region and a discharge baffle between the milling region sidewalls at the back of the milling region in close proximity to the floor of the sled. The proximity of the discharge baffle to the floor of the sled is adjustable.

The discharge baffle includes in combination a rear wall separated from the floor of the sled and extending upwardly between the milling region sidewalls at the back of the milling region and a vertically-adjustable pulverized pavement exit gate that depends from the wall. Optionally, the discharge baffle may include one or a plurality of pulverized pavement capture ledges on the rear wall facing the milling region and a pulverized pavement capture lip on the exit gate also facing the milling region.

A guard plate is secured between the milling region sidewalls forward of the milling region at a distance above the floor of the sled. The milling region sidewalls project forward of the guard plate to form opposed sidewalls of an entry scoop having a mouth located at the front of the sled. The entry scoop extends rearwardly from there into the milling region. A roofing plate bridges between the sidewalls of the entry scoop at a distance above the floor of the sled and a downwardly depending admission flap is pivotably mounted across the mouth of the entry scoop for movement into the entry scoop. The admission flap is precluded from pivoting outwardly of the entry scoop.

According to another aspect of the present invention, a pavement milling assembly includes laterally-separated left and right runners, a milling frame mounted between the runners enclosing a milling region, a milling drum upheld by the milling frame within the milling region, and a cover supported from the milling frame enclosing the milling drum. Rotation of the milling drum dislodges pavement located in the path of travel of the assembly below the floor of the assembly, pulverizes dislodged pavement, and deposits pulverized pavement to the rear of the assembly. The milling frame combines left and right milling region sidewalls extending upwardly from the floor of the assembly on opposite sides of the milling region, a guard plate secured between the milling region sidewalls forward of the milling region at a distance above the floor of the assembly, and a discharge baffle between the milling region sidewalls at the back of the milling region in close, but adjustable, proximity to the floor of the assembly.

The teachings of the present invention provide a pavement milling assembly that allows pavement being milled to remain confined in a milling region, where full pavement particle pulverization can be effected. As a result installed pavement can be milled into any desirable size. Material size is controlled by limiting the amount of pavement released at the rear of the pavement milling assembly. This present invention also improves control of milling depth by having stabilizing units in the form of elongated runners that average the surface conditions outside of pavement preselected for milling.

These and other features of the present invention will become more fully apparent from the following description, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the figures, is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The phrase "attached directly to" refers to a form of attachment by which the attached items are either in direct contact, or are only separated by a single fastener, adhesive, or other attachment mechanism. The term "abutting" refers to items that are in direct physical contact with each other, although the items may not be attached together. The terms "integrally formed" refer to a body that is manufactured integrally as a single piece without requiring the assembly of multiple pieces. Multiple parts may be integrally formed with each other, if the parts are formed from a single work piece.

Figure 1:
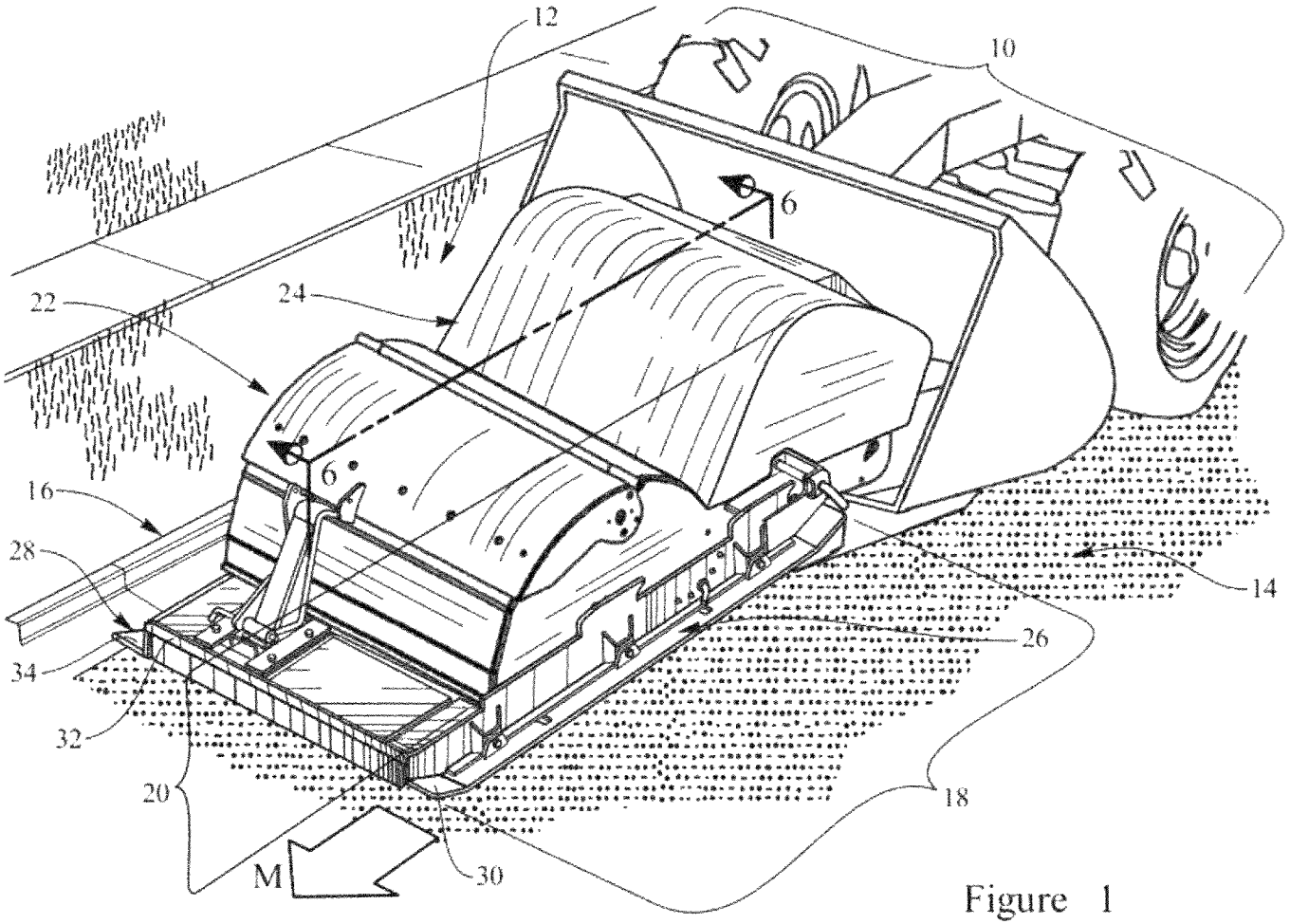
FIG. 1 is a perspective view of a propelling vehicle attached to the rear of one embodiment of a pavement milling assembly incorporating teachings of the present invention that are together engaged in milling installed pavement adjacent to a concrete curb and gutter.

FIG. 1 is a perspective view of a propelling vehicle 10 attached to the rear of one embodiment of a pavement milling assembly 12 incorporating teachings of the present invention. Propelling vehicle 10 is thereby causing pavement milling assembly 12 to travel in a forward motion M indicated in order to mill a portion of pavement 14 that is located adjacent to a concrete curb and gutter 16.

Pavement milling assembly 12 includes a pavement milling sled 18 that upholds a complex superstructure 20 that includes the active components of pavement milling assembly 12. These active components of pavement milling assembly 12 include a pavement milling drum and a drive train operably connected therewith to cause rotation thereof. Each is concealed in FIG. 1, respectively, by a milling drum cover 22 and by a drive train cover 24. Along with the active components of superstructure 20, milling drum cover 22 and drive train cover 24 are ultimately carried during travel of pavement milling assembly 12 by pavement milling sled 18.

Pavement milling sled 18 will be discussed in detail in relation to subsequent of the drawings, but it should be noted at the outset that pavement milling sled 18 travels on the surface of pavement 14 on a left runner 26 that is fully visible in FIG. 1 and on a right runner 28 that is largely concealed behind pavement milling sled 18 in FIG. 1. Left runner 26 and right runner 28 are laterally separated from each other by a distance that is approximately equal to or greater than the width of superstructure 20. Left runner 26 has an upwardly turned lead end 30 that is oriented toward the front 32 of pavement milling sled 18. Similarly, right runner 28 has an upwardly turned lead end 34 that is also oriented toward front 32 of pavement milling sled 18.

Each of left runner 26 and right runner 28 has an elongated, flat lower face that is configured for sliding travel directly on the surface of pavement 14. The lower face of left runner 26 is in a substantially coplanar relationship with the lower face of right runner 28. Accordingly, the lower faces of left runner 26 and right runner 28 will, for convenience of description herein, be used to defining a common floor F of pavement milling assembly 12 and of pavement milling sled 18 thereof. Due to the abundant detail included in FIG. 1 and in FIG. 2, floor F is not depicted herein until FIG. 3, where floor F is shown in phantom. Nonetheless, it should be understood that in FIG. 1 floor F of pavement milling assembly 12 and of pavement milling sled 18 coincides substantially with the surface of pavement 14 upon which pavement milling assembly 12 is traveling.

Left runner 26 and right runner 28 afford stable support for pavement milling assembly 12 upon the surface of pavement 14. By contacting the surface of pavement 14 over a relative extensive area, left runner 26 and right runner 28 together function to average out irregularities in the surface of pavement 14 and maintain the rotating pavement milling drum inside pavement milling assembly 12 in a relatively invariant vertical relationship to pavement 14. This results in a uniform depth to the pavement milling effected by the travel of pavement milling assembly 12 caused by propelling vehicle 10. Left runner 26 and right runner 28 also function to hold in place the portions of pavement 14 located directly there beneath, which the rotating pavement milling drum inside pavement milling assembly 12 dislodges and pulverizes the portion of pavement 14 between left runner 26 and right runner 28. This contributes to the creation of straight sides to the trench cut into pavement 14 by the pavement milling action of pavement milling assembly 12 in traveling there over.

Figure 2:
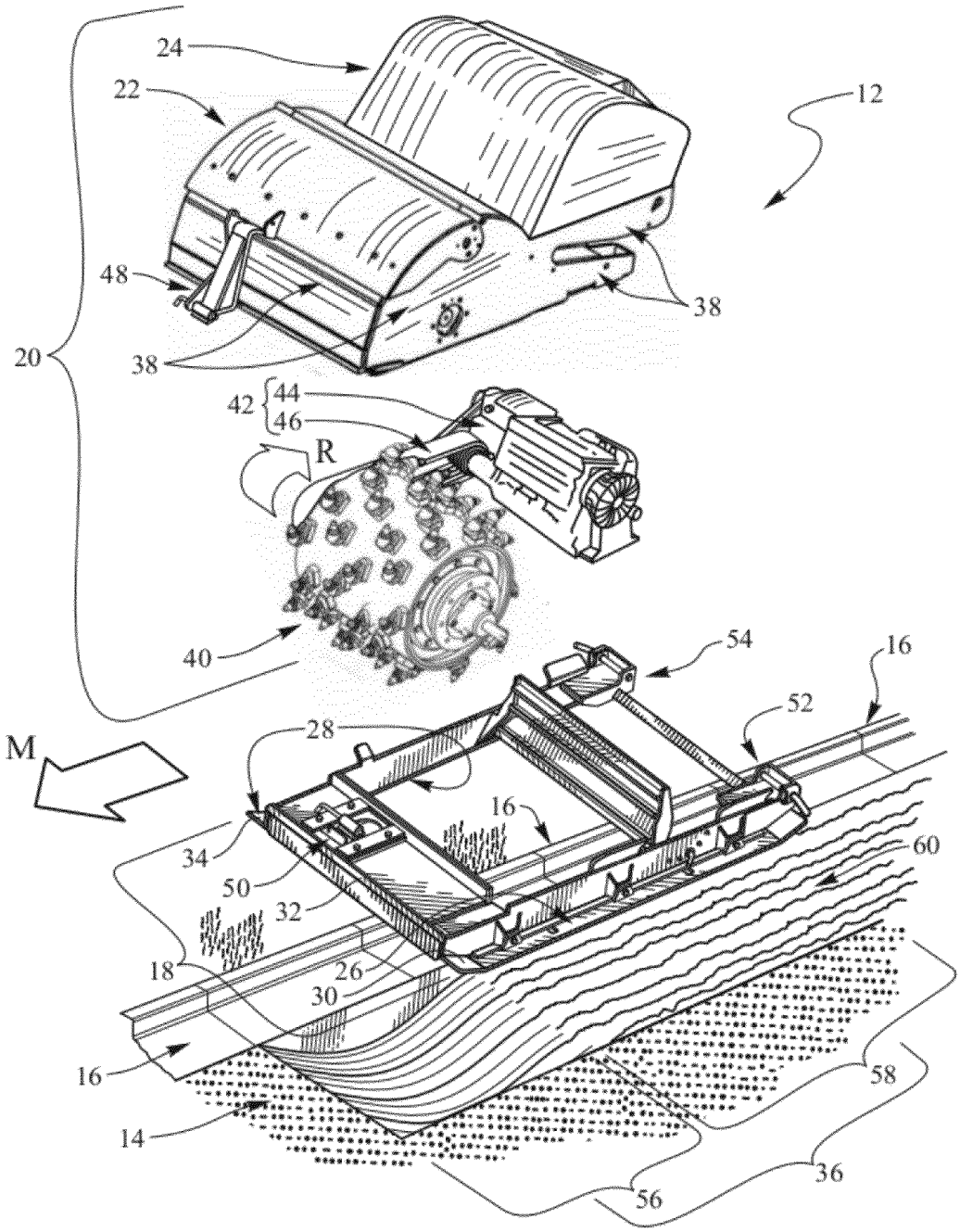
FIG. 2 is an exploded perspective view of the pavement milling assembly of FIG. 1 above the installed pavement material being milled.

Such a trench 36 formed in pavement 14 by pavement milling assembly 12 is shown by way of better understanding in FIG. 2.

There, significant subcomponents of pavement milling assembly 12 mentioned earlier are shown in exploded perspective above pavement 14, while propelling vehicle 10 has been omitted entirely. Milling drum cover 22 and drive train cover 24 can be seen to be carried directly on a superstructure scaffold 38. Also carried directly on superstructure scaffold 38 are the active components of superstructure 20, rotatable milling drum 40 and a drive train 42 that includes an engine 44 and a drive belt 46. Engine 44 is operably interconnected by drive belt 46 to milling drum 40 in such a manner as to cause milling drum 40 to engage in rotation R as shown.

Superstructure scaffold 38 is in part secured to pavement milling sled 18 by a latch 48 that cooperates with a coupling structure 50 located at front 32 of pavement milling sled 18. Other similar coupling structures 52, 54 at the rear of pavement milling sled 18 cooperate with additional latches not shown in FIG. 2 in securing superstructure scaffold 38 onto pavement milling sled 18.

A lead portion 56 of trench 36 is seen to have been cleared by the rotation of milling drum 40 of any of pavement 14, while the following portion 58 of trench 36 to the rear thereof is filled with loose, pulverized pavement granules 60 that have been deposited in portion 58 of trench 36 to the rear of pavement milling sled 18 for possible use as fresh road bed material.

Figure 3:
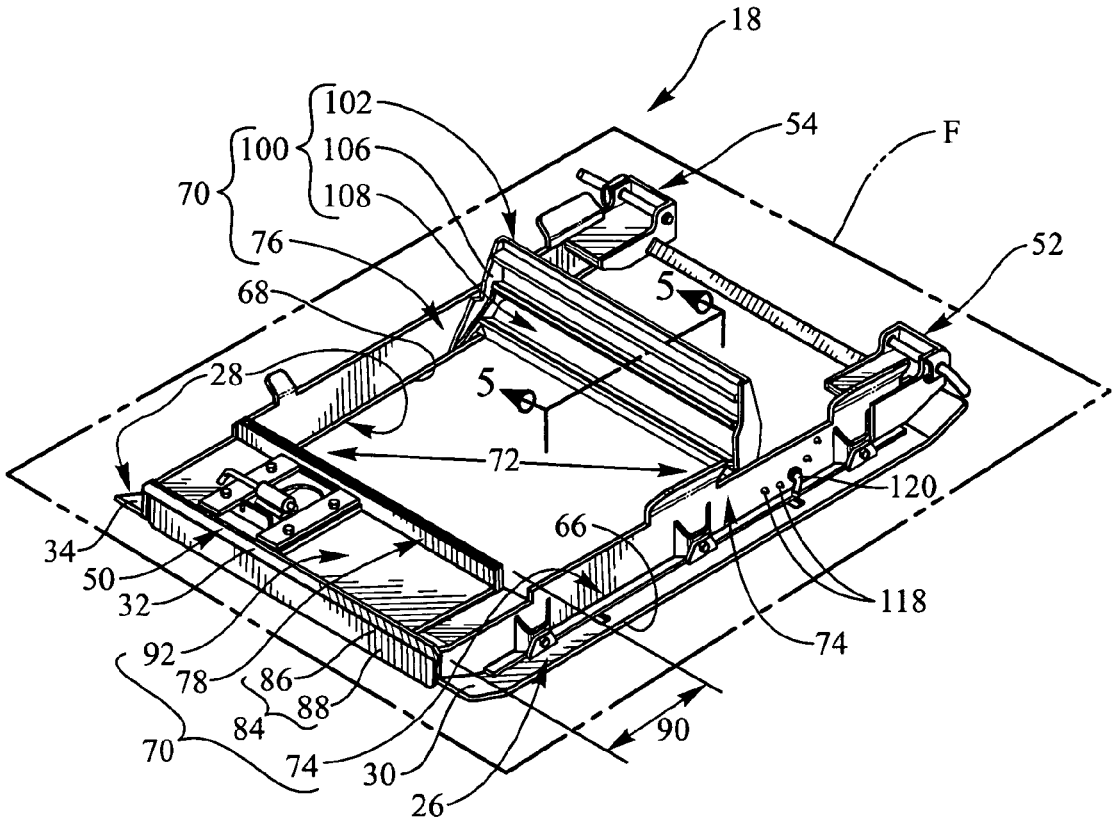
FIG. 3 is an enlarged perspective view of the pavement milling sled of the pavement milling assembly of FIG. 2.

FIG. 3 is an enlarged perspective view of pavement milling sled 18 of FIG. 2. Lower face 66 of left runner 26 and lower face 68 of right runner 28 being coplanar define phantom floor F of pavement milling sled 18, which is also the floor of pavement milling assembly 12 not shown in FIG. 3. Mounted between and upon left runner 26 and right runner 28 is a milling frame 70 that among other functions circumscribes an open-floored milling region 72. The rotation of milling drum 40 from FIG. 2 in milling region 72 dislodges pavement 14 located in the path of forward travel of pavement milling sled 18 below floor F thereof. Once dislodged, pavement 14 is pulverized by milling drum 40 into granules, such as pulverized pavement granules 60 shown in FIG. 2, and deposited in that form to the rear of pavement milling sled 18.

Milling frame 70 includes a left milling region sidewall 74 and a right milling region sidewall 76 that extend upwardly from floor F of pavement milling sled 18 on opposite sides of milling region 72. Left milling region sidewall 74 and right milling region sidewall 76 are typically heavy elongated metal plates that are positioned on the tops, respectively, of right runner 28 and left runner 26 and secured thereto by various sturdy attachment systems, such as by fasteners, bolts, welding, or screws. During pavement milling, left milling region sidewall 74 and right milling region sidewall 76 prevent the lateral escape of dislodged fragments of pavement 14 from the sides of pavement milling sled 18. Consequently, those fragments of pavement 14 remain within milling region 72 to become fully pulverized into granules, such as pulverized pavement granules 60 shown in FIG. 2.

Milling frame 70 includes additional structures that serve to confine fragments of pavement 14 within milling region 72.

One of these, a milling region front wall 78, extends upwardly above floor F of pavement milling sled 18 at the front of milling region 72. During pavement milling, milling region front wall 78 prevents the escape of dislodged fragments of pavement 14 from the front of pavement milling sled 18.

Figure 4:
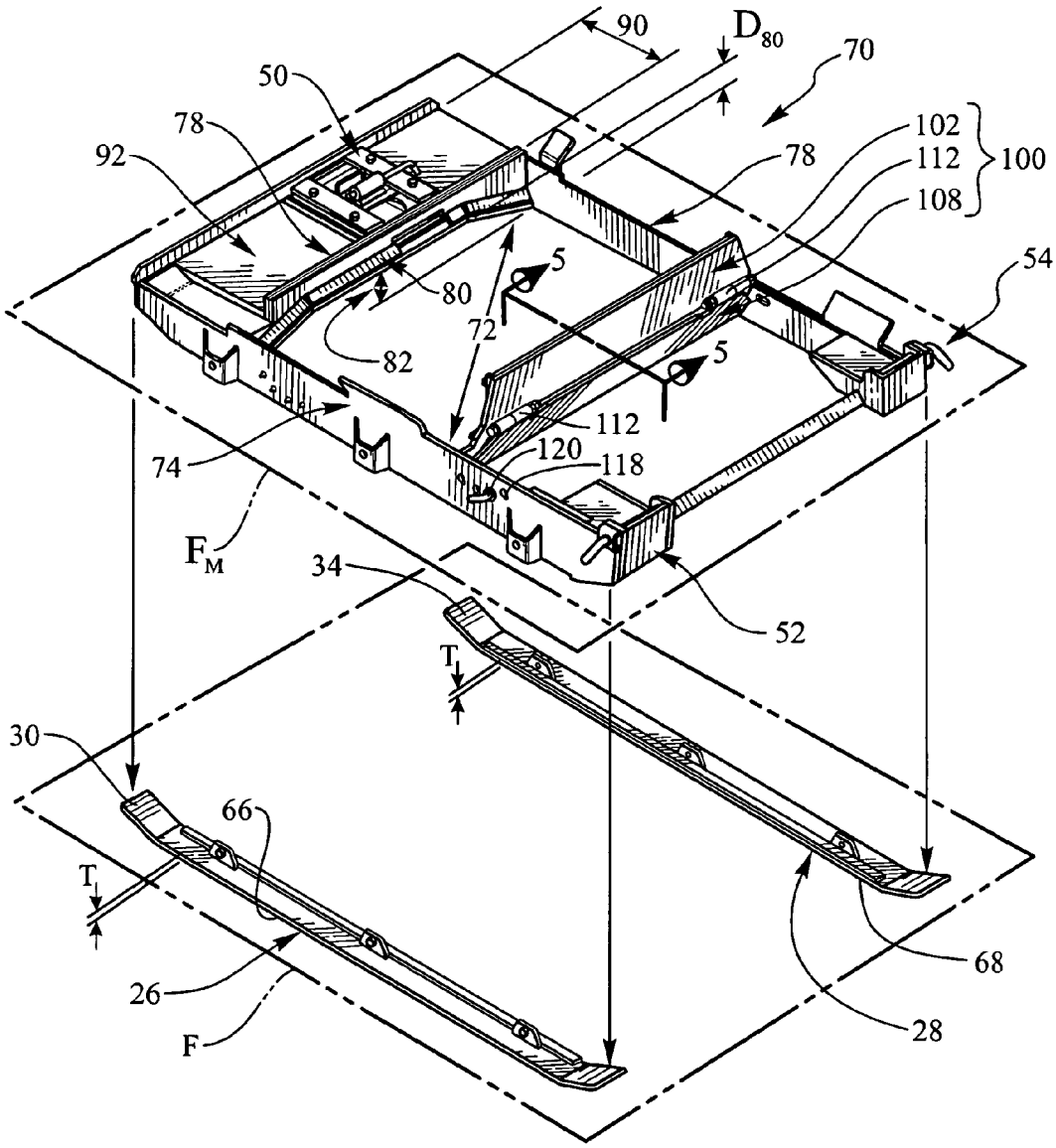
FIG. 4 is an enlarged, partially exploded perspective view of the pavement milling sled of FIG. 3 taken from a rear perspective that differs from the perspective of FIG. 3.

FIG. 4 is an exploded view of pavement milling sled 18 wherein milling frame 70 is depicted apart from left runner 26 and right runner 28. The lower surface of milling frame 70 is shown to define a milling frame floor $F_M$ that is parallel to but separated from common floor F of pavement milling assembly 12 and pavement milling sled 18 by the thickness T of each of left runner 26 and right runner 28. For most practical purposes, milling frame floor $F_M$ and common floor F are substantially identical.

In the rear perspective of pavement milling sled 18 shown in FIG. 4, it is apparent that milling region front wall 78 does not extend as far downwardly toward milling frame floor $F_M$ as do left milling region sidewall 74 and right milling region sidewall 76. The lower edge of milling region front wall 78 terminates in a heavy guard plate 80 that is secured between left milling region sidewall 74 and right milling region sidewall 76 forward of milling region 72. Guard plate 80 serves to minimize the occurrence during milling of bothersome pavement lift-up. Pavement lift-up occurs when rotating milling drum 40 encounter an edge of installed pavement in such a manner that the teeth of milling drum 40 grab the edge of the pavement and lift overly large chunks of the pavement are raised free of the ground. Once dislodged from an installed location, large chunks of pavement are difficult to pulverize into granules of an acceptably small size. Therefore, guard plate 80 is a heavily reinforced structure; so that even if milling drum 40 grabs an edge of pavement and attempts to lift a large chunk of pavement from its installed location, that chunk of pavement will impact and shatter on milling drum 40 before the chunk of pavement fully freed from the ground. Accordingly, the presence of guard plate 80 in milling frame 70 reduces pavement lift-up and contributes to more efficient pulverization of pavement into desirably-sized granules.

To optimize the effect of guard plate 80 relative to pavement lift-up, guard plate 80 should be located in as close proximity as possible to milling frame floor $F_M$. Nevertheless, other design factors must be balanced in the design of pavement milling sled 18, and FIG. 4 reveals that guard plate 80 is actually positioned at a distance $D_{80}$ above milling frame floor $F_M$. A gap 82 thus results below milling region front wall 78 between guard plate 80 and milling frame floor $F_M$. It is through gap 82 that small rocks on the surface of pavement 14 ahead of pavement milling sled 18 in the direction of forward motion M actually enter milling region 72 that is located to the rear milling region front wall 78.

For this to occur, however, pavement milling sled 18 is also provided at front 32 thereof with an elongated, downwardly depending admission flap 84 (shown in FIG. 3). Admission flap 84 is mounted along the top edge 86 thereof between left milling region sidewall 74 and right milling region sidewall 76 in such a manner as to permit the lower edge 88 thereof to pivot inwardly toward gap 82 and milling region 72. A small rock or other projection above the surface of pavement 14 ahead of pavement milling sled 18 will be brought by forward motion M of milling sled 18 to bear against the outside of admission flap 84. Then, as milling sled 18 continues to travel, the rock will pivot admission flap 84 backwards, and the rock will pass through gap 82 into milling region 72. Admission flap 84 is, however, precluded from pivoting outwardly in an opposite direction, in order to prevent particles of loose pavement in milling region 72 from being cast outside of milling sled 18 at front 32 thereof.

The portion of milling sled 18 between admission flap 84 and gap 82 can thus conveniently be conceived as an entry scoop 90 to milling region 72. The opposed sidewalls of entry scoop 90 are in this conception the portions of left milling region sidewall 74 and right milling region sidewall 76 that project forward of guard plate 80 or of milling region front wall 78. A roofing plate 92 bridges between these forward projections of left milling region sidewall 74 and right milling region sidewall 76 at a distance commensurate with the size of gap 82 above milling frame floor $F_M$. Admission flap 82 is mounted across the mouth of entry scoop 90 at front 32 of milling sled 18.

Figure 5:
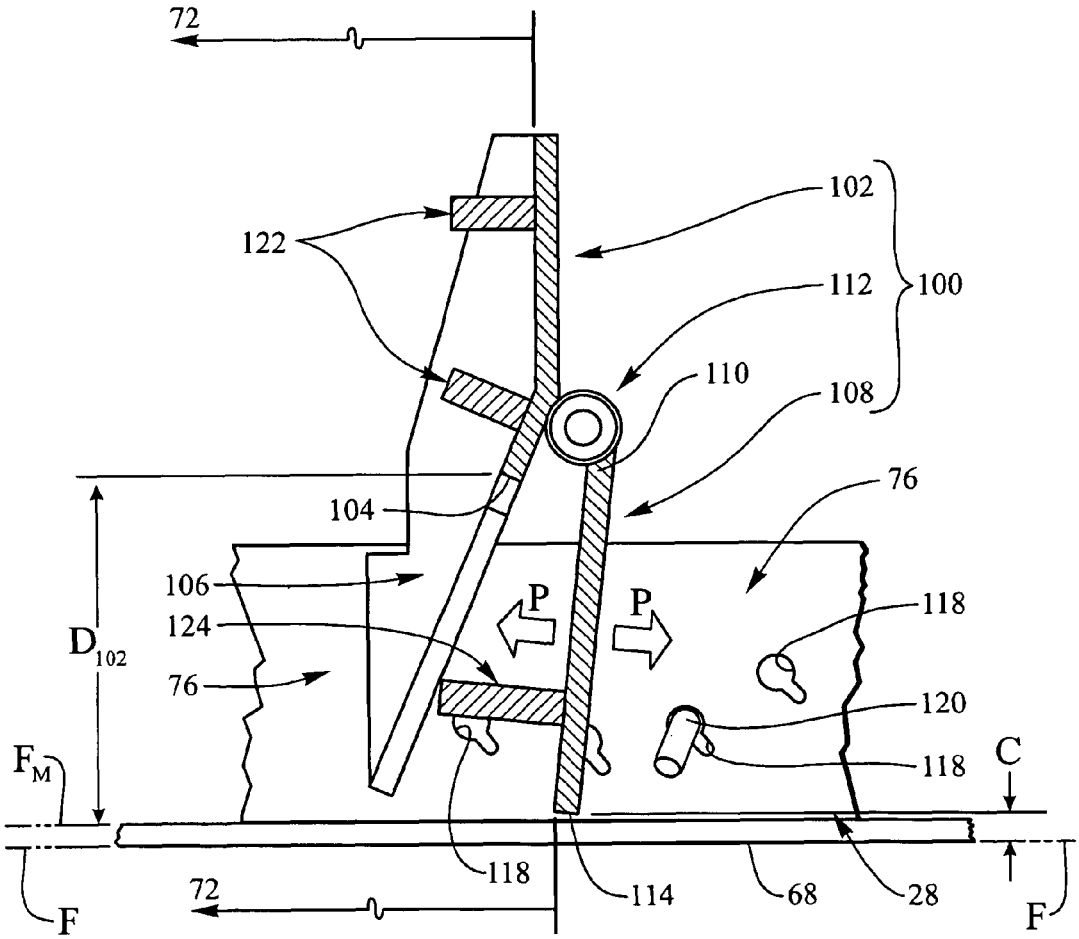
FIG. 5 is a cross-sectional elevation view of the discharge baffle of the pavement milling frame of FIGS. 3 and 4 taken along section line 5-5 shown therein.

FIGS. 3-5 taken together depict yet another structure of milling frame 70 that serves to confine fragments of pavement 14 within milling region 72. This is a discharge baffle 100 that extends upwardly from a close proximity to milling frame floor $F_M$ at the back of milling region 72 between left milling region sidewall 74 and right milling region sidewall 76. As a result of two-piece structuring, the proximity of discharge baffle 100 to milling frame floor $F_M$ is adjustable. During pavement milling, discharge baffle 100 prevents the escape of dislodged fragments of pavement 14 from the rear of pavement milling sled 18.

Discharge baffle 100 includes a rear wall 102 that is rigidly secured between right milling region sidewall 76 and left milling region sidewall 74. Rear wall 102 does not extend as far downwardly toward milling frame floor $F_M$ as do left milling region sidewall 74 and right milling region sidewall 76. Instead, rear wall 102 has a lower edge 104 that is at a distance $D_{102}$ above milling frame floor $F_M$. The opposite ends of rear wall 102 are attached to left milling region sidewall 74 and to right milling region sidewall 76 by a respective retention bracket 106.

The adjustable portion of discharge baffle 100 is a pulverized pavement exit gate 108. Pulverized pavement exit gate 108 depends by the upper edge 110 thereof toward milling frame floor $F_M$ on a pair of hinges 112 that are attached to the opposite side of rear wall 102 from milling region 72. Consequently, pulverized pavement exit gate 108 can be pivoted as suggested by arrows P in FIG. 5 about hinges 112. In this manner, pulverized pavement exit gate 108 may so be positioned as to achieve any desired clearance C between the lower edge 114 of pulverized pavement exit gate 108 and milling frame floor $F_M$. Apertures 118 and pins 120 cooperate to retain pulverized pavement exit gate 108 in any desired orientation. Thus, lower edge 114 of pulverized pavement exit gate 108 is vertically-adjustable toward the end of retaining in milling region 72 whatever quantity of pavement fragments as are calculated to produce for deposit to the rear of pavement milling sled 18 pulverized granules of an acceptable smallness.

To enhance the effectiveness of discharge baffle 100 in retaining particles of pavement 14 within milling region 72, a plurality of pulverized pavement capture ledges 122 on pulverized pavement rear wall 102 facing the milling region 72. Similarly, pulverized pavement exit gate 108 is provided with a pulverized pavement capture lip 124 near lower edge 114 thereof facing milling region 72.

Figure 6:
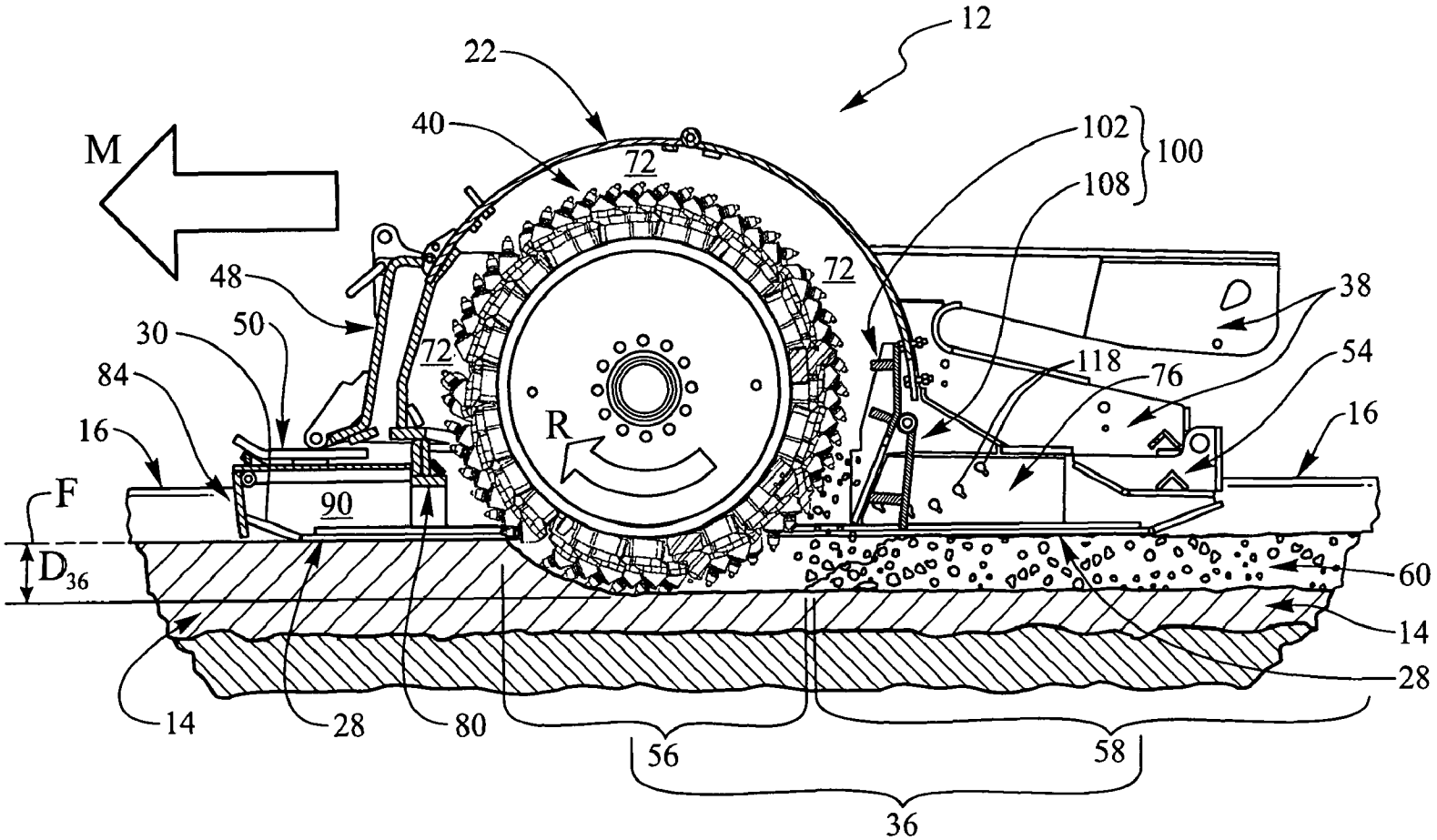
FIG. 6 is a cross-sectional elevation view of pavement milling assembly of FIG. 1 taken along section line 6-6 shown therein.

FIG. 6 is a cross-sectional elevation view taken along section line 6-6 of FIG. 1 to depict pavement milling assembly 12 being used to mill installed pavement 14. For clarity, drive train 42 and drive train cover 24 have been omitted, but milling drum 40 engaging in rotation R can be seen enclosed by milling drum cover 22 in milling region 72. Milling drum 40 accordingly cuts a trench 36 through installed pavement 14 to at a depth $D_{36}$, which may be adjusted by changing the height of milling drum 40 within pavement milling assembly 12. Guard plate 80 suppresses pavement up-lift, while admission flap 84 allows small rocks and irregularities in the surface of pavement 14 to enter milling region 72 through entry scoop 90. Milling region front wall 78, left milling region sidewall 74, right milling region sidewall 76, and discharge baffle 100 retain loose pavement particles within milling region 72 to effect full pulverization.

The teachings of the present invention allow a road-repair crew to easily repair or re-surface an area of a road very quickly and easily. Because particles of dislodged pavement are confined with as rotating milling drum within a small milling region, a pavement milling assembly embodying those teachings capable of fully pulverizing those particles, even if the milling drum is not at its full depth.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A pavement milling sled of the type that upholds a rotating pavement milling drum as the sled travels over pavement preselected for milling, said milling sled comprising:

laterally-separated left and right runners, each of said runners having, respectively, a lead end oriented toward the front of said sled and a lower face configured for sliding travel on the surface of the pavement, said lower faces of said runners being substantially coplanar and thereby defining a floor of said sled; and a milling frame mounted between said runners, said milling frame circumscribing a milling region, the milling region extending from front to back over the milling drum, front-to-back rotation of the milling drum in said milling region dislodging pavement located in the path of forward travel of said sled below said floor thereof, carrying pavement over the milling drum, pulverizing dislodged pavement into granules, and depositing pulverized pavement granules to the rear of said sled, said milling frame comprising:

a guard plate forward of the milling drum that reduces pavement lift-up, thereby contributing to more efficient pulverization of pavement into desirably-sized granules;

left and right milling region sidewalls extending upwardly from said floor of said sled on opposite sides of said milling region; and an adjustable discharge baffle between said milling region sidewalls at the back of said milling region in close proximity to said floor of said sled, also the discharge baffle is in close proximity to the milling drum to confine fragments of pavement within the milling region for pulverizing into granules of a desirable small size, the adjustment of the proximity of the discharge baffle to the floor and the milling drum controls granule size.

2. A milling sled as recited in claim 1, wherein said discharge baffle comprises:

a rear wall separated from said floor of said sled and extending upwardly between said milling region sidewalls at the back of said milling region; and a vertically-adjustable, hinged pulverized pavement exit gate depending from said rear wall.

3. A milling sled as recited in claim 2, wherein said discharge baffle further comprises a pulverized pavement capture ledge on said rear wall facing said milling region.

4. A milling sled as recited in claim 2, wherein said discharge baffle further comprises a pulverized pavement capture lip on said exit gate facing said milling region.

5. A milling sled as recited in claim 1, wherein said milling frame further comprises a coupling structure capable of securing the milling drum to said sled.

6. A milling sled as recited in claim 1, wherein said milling region sidewalls project forward of said guard plate to form opposed sidewalls of an entry scoop, said entry scoop having a mouth located at said front of said sled, and said entry scoop extending rearwardly therefrom to said milling region.

7. A milling sled as recited in claim 6, wherein said entry scoop further comprises:

a roofing plate bridging between said sidewalls of said entry scoop at a distance above said floor of said sled; and a downwardly depending admission flap pivotably mounted across said mouth of said entry scoop for movement into said entry scoop.

8. A milling sled as recited in claim 7, wherein said admission flap is precluded from pivoting outwardly of said entry scoop.

9. A pavement milling assembly comprising:

laterally-separated left and right runners, each of said runners having, respectively, a lead end oriented toward the front of said assembly and a lower face configured for sliding travel on the surface of pavement preselected for milling, said lower faces of said runners being substantially coplanar and thereby defining a floor of said assembly;

a milling frame mounted between said runners and circumscribing a milling region, the milling region extending from front to back over a milling drum, said milling frame comprising:

left and right milling region sidewalls extending upwardly from said floor of said assembly on opposite sides of said milling region;

a guard plate secured between said milling region sidewalls forward of said milling drum at a distance above said floor of said assembly; and an adjustable discharge baffle between said milling region sidewalls at the back of said milling region in close proximity to said floor of said assembly;

the milling drum upheld by said milling frame within said milling region, front-to-back rotation of said milling drum dislodging pavement located in the path of travel of said assembly below said floor thereof, carrying pavement over the milling drum, pulverizing dislodged pavement into granules, and depositing pulverized pavement granules to the rear of said assembly, the discharge baffle is in close proximity to the milling drum to confine fragments of pavement within the milling region for pulverizing into granules of a desirable small size, the adjustment of the proximity of the discharge baffle to the floor and the milling drum controls granule size; and a cover supported from said milling frame and enclosing said milling drum.

10. A pavement milling assembly as recited in claim 9, further comprising a drive train carried on said milling frame and operably interconnected to rotate said milling drum.

11. A pavement milling assembly as recited in claim 9, wherein said discharge baffle comprises:

a rear wall separated from said floor of said sled and extending upwardly between said milling region sidewalls at the back of said milling region separated from said floor of said sled;

a pulverized pavement capture ledge on said rear wall facing said milling region;

a vertically-adjustable, hinged pulverized pavement exit gate depending from said rear wall; and a pulverized pavement capture lip on said exit gate facing said milling region.

12. A pavement milling assembly as recited in claim 9, wherein said milling region sidewalls project forward of said guard plate to form opposed sidewalls of an entry scoop, said entry scoop having a mouth located at said front of said assembly, and said entry scoop extending rearwardly therefrom into said milling region.

13. A pavement milling assembly as recited in claim 9, wherein said entry scoop further comprises:

a roofing plate bridging between said sidewalls of said entry scoop at a distance above said floor of said assembly; and a downwardly depending admission flap pivotably mounted across said mouth of said entry scoop for movement into said entry scoop, said admission flap being precluded from pivoting outwardly of said entry scoop.

14. A pavement milling frame of the type having an open floor and circumscribing a milling region in which the milling frame upholds a rotating milling drum as the milling frame travels over pavement preselected for milling, the milling region extending from front to back over the milling drum, front-to-back rotation of the milling drum dislodging pavement located in the path of travel of the milling frame below the floor thereof, carrying pavement over the milling drum, pulverizing dislodged pavement into granules, and depositing pulverized pavement granules to the rear of the milling frame, said milling frame comprising:

left and right milling region sidewalls extending upwardly from the floor of said milling frame on opposite sides of the milling region;

a guard plate secured between said milling region sidewalls forward of the milling region at a distance above said floor of the milling frame; and an adjustable discharge baffle between said milling region sidewalls at the back of the milling region in vertically-adjustable proximity to the floor of said milling frame, the discharge baffle is in close proximity to the milling drum to confine fragments of pavement within the milling region for pulverizing into granules of a desirable small size, the adjustment of the proximity of the discharge baffle to the floor and the milling drum controls granule size.

15. A milling frame as recited in claim 14, wherein said discharge baffle comprises:

a rear wall separated from said floor of said sled and extending upwardly between said milling region sidewalls at the back of said milling frame; and a vertically-adjustable, hinged pulverized pavement exit gate depending from said rear wall.

16. A milling frame as recited in claim 15, wherein said discharge baffle further comprises:

a pulverized pavement capture ledge on said rear wall facing the milling region; and a pulverized pavement capture lip on said exit gate facing the milling region.

17. A milling frame as recited in claim 14, further comprising a milling region entry scoop having a mouth located at the front of said milling frame and an open floor coincident with the floor of the milling frame, said entry scoop extending rearwardly from said mouth thereof in to communication with the milling region between said guard plate and the floor of the milling frame.

18. A milling frame as recited in claim 17, wherein said entry scoop comprises:

left and right entry scoop sidewalls extending upwardly from the floor of said milling frame on opposite sides of said entry scoop;

a roofing plate bridging between said sidewalls of said entry scoop at a distance above the floor of said milling frame; and a downwardly depending admission flap pivotably mounted across said mouth of said entry scoop for movement into said entry scoop, said admission flap being precluded from pivoting outwardly of said entry scoop.

* * * * *